US005648129A

United States Patent [19]

Lee et al.

[11] Patent Number: 5,648,129

[45] Date of Patent: Jul. 15, 1997

[54] MELODIC PARTY-FAVORS

[76] Inventors: Seung Soo Lee, 708 Walnut Dr., Franklin Lakes, N.J. 07417; Jae Chul Lee, 213-9 33/3 Jang-Jun-1-Dong Kum-Kung-Ku, Pusan, Rep. of Korea

[21] Appl. No.: 377,642

[22] Filed: Jan. 25, 1995

[51] Int. Cl.[6] ..... A41G 1/00

[52] U.S. Cl. ..... 428/24; 40/455; 428/3; 431/253

[58] Field of Search ..... 428/24, 26, 3; 40/455; 362/119, 122; 431/253

[56] References Cited

U.S. PATENT DOCUMENTS

| | | | |
|---|---|---|---|
| 4,299,041 | 11/1981 | Wilson | 428/24 X |
| 4,477,249 | 10/1984 | Ruzek et al. | 431/253 |
| 4,525,821 | 7/1985 | Garcia | 428/3 X |
| 4,568,269 | 2/1986 | Lin | 431/253 |
| 4,804,323 | 2/1989 | Kim | 431/253 |
| 4,910,647 | 3/1990 | Gong | 428/24 X |
| 5,015,175 | 5/1991 | Lee | 431/253 |
| 5,072,743 | 12/1991 | Perrine | 131/360 |
| 5,277,645 | 1/1994 | Kelley et al. | 428/3 X |
| 5,363,590 | 11/1994 | Lee | 431/253 |

*Primary Examiner*—Henry F. Epstein
*Attorney, Agent, or Firm*—Selitto & Associates

[57] ABSTRACT

The present invention provides a melodic novelty party-favor article comprising a housing and an electronic circuit assembly. The housing contains the electronic circuit assembly, which comprises a power source, an integrated circuit unit, a sound production means and a switch mechanism. The switching mechanism comprises two electrically conductive ends and a resistor, wherein the conductive ends are contiguously placed on an outer surface portion of the housing and are not in contact with each other, whereby the circuit assembly is activated by simultaneously contacting the two electrically conductive ends with an electrically conductive article.

14 Claims, 3 Drawing Sheets

MELODIC PARTY-FAVORS

BACKGROUND OF THE INVENTION

The present invention relates to melodic novelty party-favors containing an integrated circuit capable of producing sounds such as musical tones and emulated voice messages.

There are many novelty party-favors, i.e., novelty items that are utilized to enhance festive mood of a party or gathering, that are utilized to enhance the festivity of special occasions, such as birthday and holiday parties and various anniversary gatherings. Illustrative examples of party-favors include balloons, candles, hats, batons, artificial flowers and the like. However, most of commonly available party-favors provide only visual effects or audio effects. It is desirable to have party-favors that provide combined audio and visual effects to enhance the festivity of special occasions.

SUMMARY OF THE INVENTION

There is provided in accordance with the present invention a melodic novelty party-favor article comprising a housing and an electronic circuit assembly. The housing contains the electronic circuit assembly, which comprises a power source, an integrated circuit unit that contains one or more of preprogrammed sound sequences, a sound production means that converts the programmed sound sequences to audible sounds and a switch mechanism that is connected to and controls the integrated circuit unit. The switch mechanism comprises two electrically conductive ends and a resistor, wherein the conductive ends are contiguously placed on an outer surface portion of the housing and are not in contact with each other, whereby the circuit assembly is activated by simultaneously contacting the two electrically conductive ends with an electrically conductive surface.

In accordance with the present invention, the housing can be in the form of a novelty party-favor article, such as a flower, wand, knife, cake-server, hat or balloon, and are produced from a electrically non-conductive material, such as paper, plastics, wood, rubbers and the like.

DETAILED DESCRIPTION OF THE INVENTION

While the invention will be described in connection with exemplary embodiments, it is not intended to limit the scope of the present invention to those embodiments.

Figure 1:
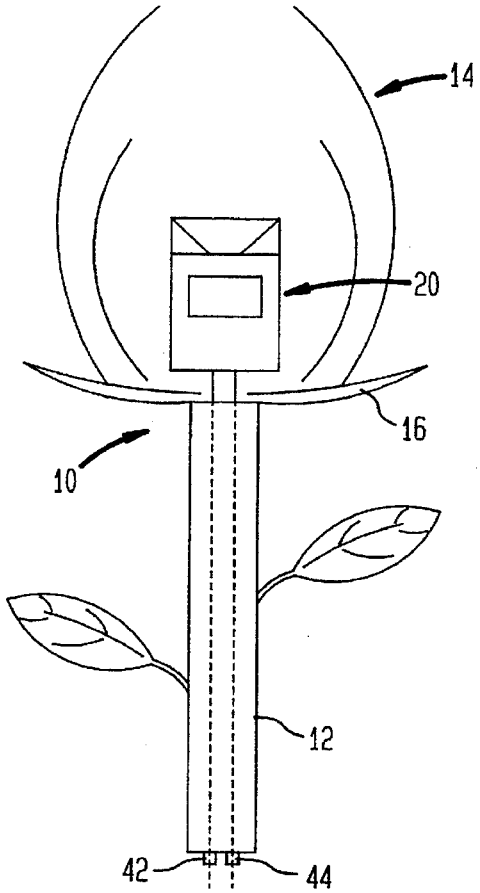
FIG. 1 illustrates an artificial flower that houses the electronic circuit assembly of the present invention.

Referring to FIG. 1, as an example, there is illustrated a melodic artificial flower 10. The melodic flower contains an electronic circuit assembly 20, which is illustrated further in FIG. 2. The electronic circuit assembly 20 contains an integrated circuit unit (ICU) 22, a power source 24, a switch mechanism 26 and a sound production mechanism, e.g., a speaker, 28. The circuits of the electronic circuit assembly 20 are complete and closed except for the switch mechanism 26.

The ICU 22 contains a memory stage 30. The memory stage 30 contains preprogrammed electronic signal sequences that are converted to audible tones or messages through the speaker 28 when the switch mechanism 26 is closed and activates the ICU 22. The ICU 22 contains programs that play one or more of complete cycles of preprogrammed electronic signals of audible tones or messages once the switch mechanism 26 is closed to activate the ICU. The program in the ICU preferably is a program that completes the preprogrammed cycle or cycles even when the switch mechanism is opened before the completion of the programmed cycle. However, different needs for different party-favors may require that the playing duration of the electronic signals that are programmed in the ICU needs to correspond to the closing sequence and duration of the switch mechanism. Additionally, if there is a specific requirement to have the electronic signals from the ICU and, correspondingly, the auditory message therefrom to respond to the closing sequence and duration of the switch mechanism, it may be desirable to program the ICU to reset itself to the initial stage of its programmed cycle when the switch mechanism is opened after each use. As is well known in the art, ICUs suitable for the present invention may be programmed with various musical tones and/or voice messages, and they are commercially available. An illustrative example of such ICUs is Melody IC ERSO 3830 SER. Such suitable integrated circuit units are conventional and within the current state of the relevant art; consequently, no further description is disclosed herein.

The ICU 22 may also contain an amplifier 32 that amplifies the electronic signals from the ICU, if a louder audible response is desired. The power source 24, e.g., a battery, is selected to properly accommodate the requirements of the electronic circuit assembly 20, especially the ICU 22. In accordance with the convention of the relevant electronic circuit art, the preferred ICU has 1.5 volt circuitries and, correspondingly, the preferred power source potential is 1.5 volt.

The switch mechanism 26 contains a resistor 34, a bipolar transistor 35 and a physical interruption 36. The resistor 34 is connected between the power source 24 and the memory stage 30, and the bipolar transistor 35 is placed in series with the resistor 34 with respect to the power source 24. The bipolar transistor 35 contains a collector terminal, a base terminal and a emitter terminal. The collector terminal is connected to the positive polarity of the power source 24; the base terminal is connected to the physical interruption 36; and the emitter terminal is connected to the memory stage 30. As mentioned above, the electronic circuit assembly 20 is a closed circuit except for the switch mechanism, more particularly the physical interruption 36. The interruption 36 is a break in the circuit, creating a first conductive terminal 38 and a second conductive terminal 39. The first and second terminals 38, 39 are fabricated from an insulated conductive material, e.g., insulated wire. The first terminal 38 is connected to the positive potential of the power source 24, and the second terminal 39 is connected to the transistor 35, more particularly the base terminal of the transistor. The first and second terminals 38, 39 are extended away from the electronic circuit assembly 20 and are connected to a first electrically conductive end 42 and a second electrically conductive end 44, respectively. In order to facilitate an easy activation of the ICU, the first and second conductive ends 42, 44 can be fitted with a conductive material having a large surface area. The conductive ends 42, 44 can be strips or wires fabricated from an electrically conductive material, for example, metal, e.g., copper and aluminum; an electrically conductive polymer, e.g., polyaniline; or a conductively modified polymer, e.g, a carbon or metal particle filled rubber. The conductive ends 42, 44 are exposed to the exterior surface of the flower stem 12 and are placed and affixed closed to each other, but they must not touch each other. When the conductive ends 42, 44 are simultaneously contacted with an electrically conductive material, the electrical current is conveyed to the bipolar transistor 35 and then the transistor 35 amplifies the current to a level that activates the ICU. The activated ICU causes the preprogrammed tone or message to be audibly played through the speaker 28. Although any conductive material may be employed to activate the ICU, the more desired method of activating the ICU in accordance with the present invention is simultaneously contacting the two conductive ends 42, 44 with the human skin.

In accordance with the present invention, the sensitivity of the switch mechanism can be controlled by varying the resistance level of the resistor 34, thereby making the switch mechanism sensitive enough to activate the ICU even when a relatively low conductive material such as the human skin is employed to close the switch mechanism and thus activate the ICU. However, the sensitivity of the switch mechanism should not be too high as to activate the ICU when contacted by a materials that is less conductive than the human skin, thereby preventing unexpected or unwanted activation of the ICU. For example, when the method of activation is a human skin contact, the suitable resistance is between about 10 megohms and about 100 megohms, preferably between about 25 megohms and about 90 megohms, more preferably between about 50 megohms and about 80 megohms, and most preferably between about 60 megohms and about 75 megohms. Referring back to FIG. 1, the melodic flower 10 houses the electronic circuit assembly 20 inside its flower petals 14, and the electronic circuit is firmly affixed to the flower base 16. The conductive ends 42, 44 are placed at the end of the flower stem 12. However, the placement of the conductive ends 42, 44 is not critical as long as the position of the exposed conductive ends are easily accessible to the user. As stated above, the electronic circuit assembly 20 is activated to produce audible tones or messages when the conductive ends 42, 44 are simultaneously contacted by a conductive material or simultaneously touched.

Figure 3:
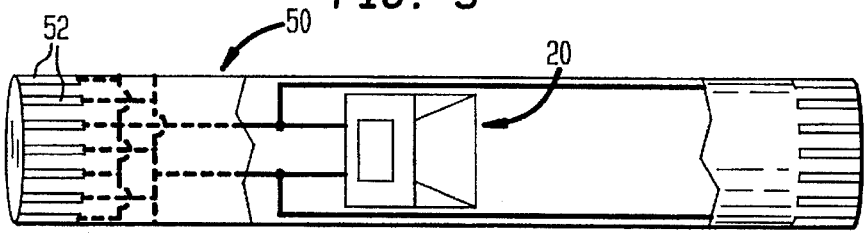
FIGS. 3 and 4 illustrates wands that are equipped with and house the present electronic circuit assembly.

Now referring to FIG. 3, a wand 50 is equipped with the electronic circuit assembly 20. The electronic circuit assembly is the same assembly described above in connection with the melodic flower. One or both ends of the wand 50 may be equipped with a multitude of regularly placed strips 52 of a conductive material that are separated by a small gap and are firmly affixed to the peripheral surface of the ends, forming conductive ends. The conductive strips 52 are alternatively connected to the first terminal 38 and the second terminal 39 of the electronic circuit assembly 20. Consequently, when at least one end of the wand 50 is touched or contacted with a conductive material, thereby simultaneously contacting the first and second terminals, the switch mechanism is closed, activating the ICU 20 and playing the preprogrammed audible tone or message. It is to be noted that as the width of the conductive strips 52 decreases, consequently increasing the number of the conductive strips on the wand, the likelihood of simultaneously connecting the two terminals 38, 39 and thus activating the ICU increases.

Figure 4:
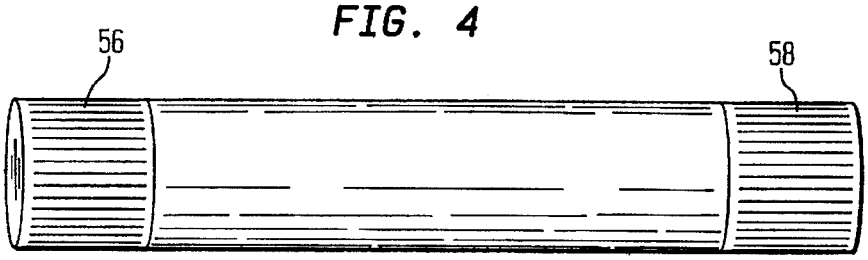

Alternatively, each of the two ends of the wand may be fitted with a conductive material that completely wraps the outer periphery of the end, forming two fitted ends 56, 58, as illustrated in FIG. 4. One of the fitted ends 56 is connected to the first terminal 38 of the switch mechanism, and the other end 58 is connected to the second terminal 39. A melodic wand equipped with this switch arrangement can be activated by one person simultaneously touching both ends of the wand. If desired, the wand can be made highly sensitive enough such that two persons physically separated by a short distance can be able to activate the ICU when each person simultaneously touches each end of the wand.

Figure 5:
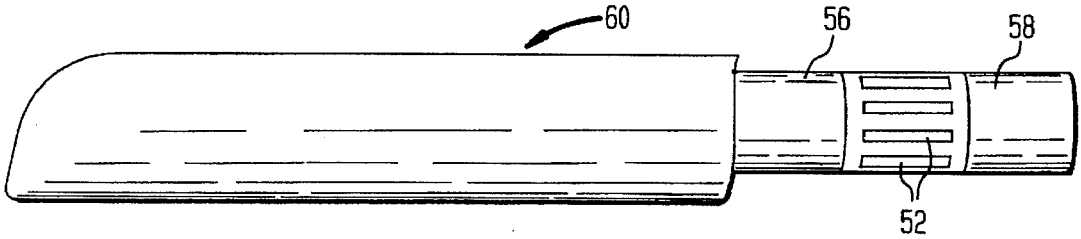
FIG. 5 illustrates a knife equipped with the electronic circuit assembly.
Figure 6:
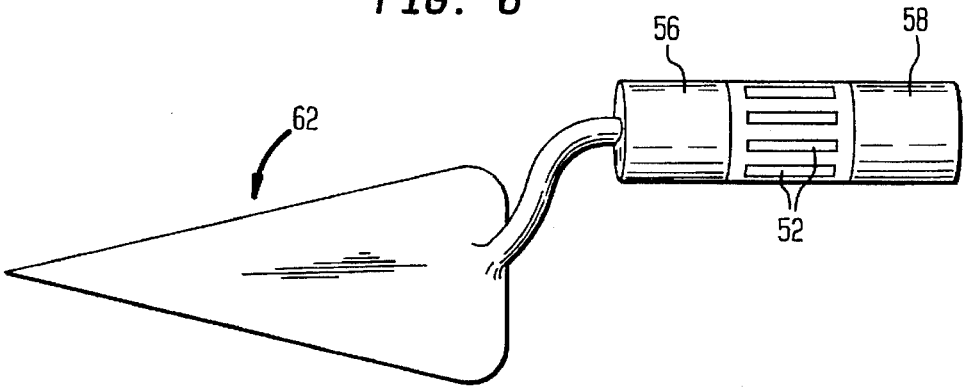
FIG. 6 illustrates a cake-server equipped with the electronic circuit assembly.

Yet other exemplary uses of the present electronic circuit assembly are illustrated in FIGS. 5 and 6. FIG. 5 illustrates a knife 60, more particularly a cake knife, and FIG. 6 illustrates a cake server 62. The electronic circuit assembly is placed inside of the handles of the knife and server, and both of the switch mechanism described above in connection with the wand 50 are equipped on the handles. Although FIGS. 5 and 6 disclose party-favor articles having two types of switch mechanisms, only one of the two switch mechanisms is necessary to activate the electronic circuit assembly provided that the switch mechanism is placed in an easily accessible location on the handles for easy activation of the ICU.

Figure 2:
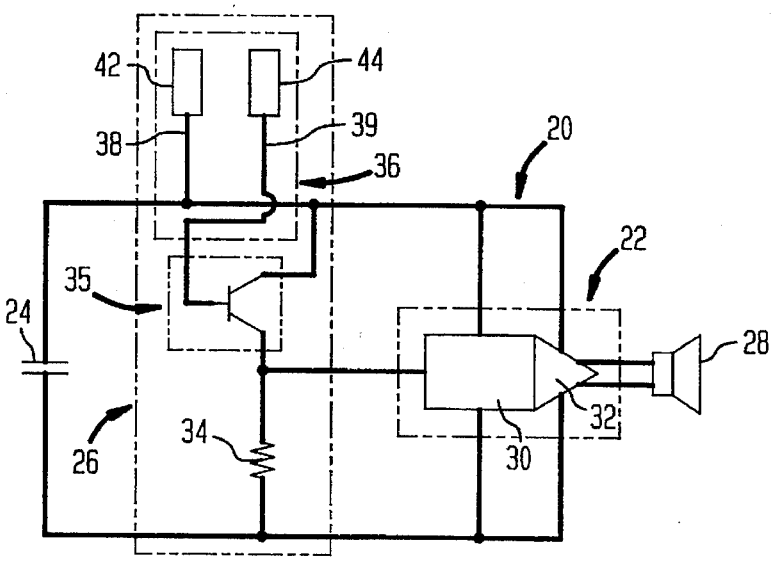
FIG. 2 illustrates an electronic circuit assembly of the present invention.
Figure 7:
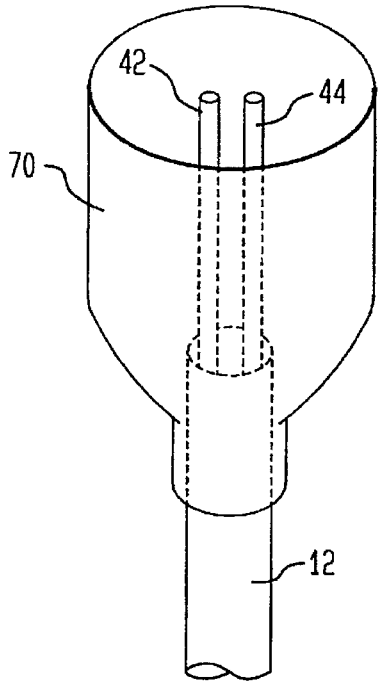
FIG. 7 illustrates a resilient, conductive member that can be used to activate the electronic circuit assembly.

As another embodiment of the present invention, the switch mechanism may additionally contain a resilient, conductive member that surrounds or covers both of the conductive terminals of the physical interruption, 36 of FIG. 2, of the switch mechanism but do not make contact with one or both of the terminals, 38 and 39 of FIG. 2. The resilient, conductive member is placed over the two terminals so that when the conductive member is depressed, e.g., by a finger, the conductive member contacts both of the terminals to complete the circuit, activating the circuit and the ICU. In addition, the conductive member is resilient such that it substantially returns to its original position, deactivating the circuit, when the pressure is removed. Suitable conductive member can be produced from a wide variety of elastomers or elastomeric materials, including natural rubber, neoprene, polyurethane, styrene-butadiene rubbers, butadiene rubbers, ethylene-propylene rubbers, silicone elastomers and fluoro elastomers, provided that the elastomeric materials are modified to be electrically conductive. The modification of the elastomeric material can be accomplished by any known means such as dispersing or filling fine carbon or metal particles while the elastomeric material is in a fluid or molten state, or laminating a conductive metal foil on the inside surface of the conductive member which is fabricated from an elastomeric material. FIG. 7 illustrates an example of the conductive member that is fitted at the end of the stem 12 of the above illustrated melodic flower 10. For example, the suction-cup-shaped resilient conductive member 70 is molded from a silicone rubber composition that is filled with fine metal particles. The small opening of the conductive member 70 is tightly and permanently fitted over the end of the stem 12, and the first and second electrically conductive ends, 42 and 44, are enclosed within the conductive member 70 but do not make contact with the conductive member. When the resilient conductive member 70 is squeezed to make a contact with both of the electrically conductive ends, 42 and 44, the circuit is completed and the ICU is activated to play the programed audible sound.

Figure 8:
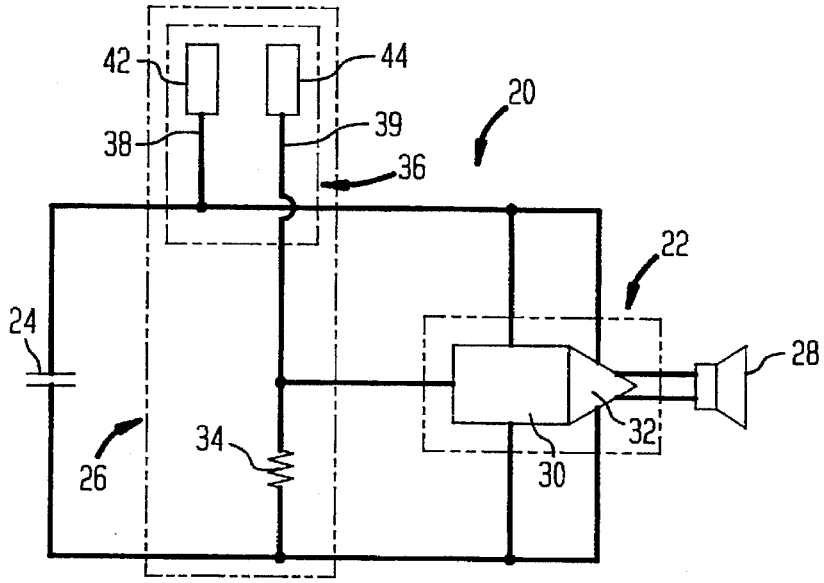
FIG. 8 illustrates another electronic circuit assembly of the present invention.

The use of the resilient conductive member may be advantageous in that the sensitivity of the switch mechanism can be retarded to prevent false activations of the ICU, e.g, activation by ambient static conditions or accidental contacting of the conductive ends. In addition, the use of the resilient conductive member allows simplification of the electronic circuit assembly 20. When the resilient conductive member is utilized, the bipolar transistor can be eliminated from the electronic circuit assembly, as shown in FIG. 8. Since the conductive member allows a sufficient level of electrical flow that is high enough to activate the ICU, the need for the amplification which is provided by the bipolar transistor is eliminated. Consequently, when the resilient conductive member is utilized, the sensitivity of the switch mechanism can be reduced. The resistor 34 of the switching mechanism should be have a resistance between about 1 megohms and about 20 megohms, preferably between about 5 megohms and about 15 megohms, more preferably between about 8 megohms and about 12 megohms.

The present electronic circuit assembly can be placed in many different novelty articles that are used to enhance festive mood of special occasions, e.g., birthdays, holidays, various anniversaries and the like, and such novelty articles include flowers, batons, candles, hats, cake-serving utensils and the like.

What is claimed is:

1. A melodic novelty article, comprising a body including a gripping portion for providing a handgrip along said body, said gripping portion having a generally elongated shape; and an electronic circuit assembly mounted in said body and including an integrated circuit unit, which is programed with at least one sound sequence, sound producing means for receiving said sound sequence from said integrated circuit unit and converting same to audible sounds, and a normally open switch connected to said integrated circuit unit for activating same and having a pair of conductive ends, which are contiguously located in said gripping portion, said conductive ends being spaced apart such that they are electrically connected to each other when a person grips said gripping portion, thereby closing said switch and hence activating said circuit assembly to produce audible sounds.

2. The melodic novelty article of claim 1, further comprising a conductive member enclosing said conductive ends for electrically connecting said conductive ends to each other.

3. The melodic novelty article of claim 2, wherein at least one of said conductive ends is out of contact with said conductive member when said gripping portion is not gripped.

4. The melodic novelty article of claim 3, wherein said conductive member is resilient such that when a person grips said gripping portion, said conductive member moves to come in contact with said conductive ends, thereby electrically connecting said conductive ends to each other, and such that when said gripping portion is released, said conductive member returns to its substantially original shape, thereby electrically disconnecting said conductive ends from each other.

5. The melodic novelty article of claim 4, wherein said body includes a stem defining said gripping portion.

6. The melodic novelty article of claim 5, wherein said conductive ends and said conductive member are positioned on said stem.

7. The melodic novelty article of claim 6, wherein said body has a flower shape.

8. The melodic novelty article of claim 1, wherein said body includes a handle defining said gripping portion.

9. The melodic novelty article of claim 8, wherein one of said conductive ends is positioned on one side of said handle and the other one of said conducive ends is positioned on an opposite side of said handle.

10. The melodic novelty article of claim 9, wherein at least a portion of each of said conductive ends is exposed such that when a person grips said handle, a hand of the person comes in contact with said conductive ends, thereby electrically connecting said conductive ends to each other.

11. The melodic novelty article of claim 10, wherein said electronic circuit assembly is housed in a wand mounted on said handle.

12. The melodic novelty article of claim 11, wherein said body has the shape of a cake server.

13. The melodic novelty article of claim 1, wherein said circuit includes a resistor connected to one of said conductive ends and said integrated circuit unit.

14. The melodic novelty article of claim 13, wherein said resistor functions to regulate the sensitivity of said switch.

* * * * *